United States Patent [19]

Crosslen

[11] 3,942,647

[45] Mar. 9, 1976

[54] MERCHANDISE DISPLAY RACK

[75] Inventor: Louis John Crosslen, Grafton, Wis.

[73] Assignee: Frank Mayer & Associates, Inc., Grafton, Wis.

[22] Filed: Mar. 17, 1975

[21] Appl. No.: 558,642

[52] U.S. Cl. ..... 211/144; 211/131; 211/163; 211/177; 108/94; 312/125

[51] Int. Cl.[2] ..... A47F 5/02

[58] Field of Search ..... 211/163, 144, 131, 177, 211/58, 70, 78, 95, 115, 129; 248/DIG. 3, 131, 349; 108/61, 94, 92, 103; 312/252, 125, 123

[56] References Cited

UNITED STATES PATENTS

| | | | |
|---|---|---|---|
| 1,810,941 | 6/1931 | Blomberg | 211/163 X |
| 2,621,429 | 12/1952 | Teich | 211/163 X |
| 3,187,924 | 6/1965 | Marcus | 248/DIG. 3 |
| 3,502,226 | 3/1970 | Marchak | 211/163 |
| 3,756,421 | 9/1973 | Wilkins | 211/177 X |

FOREIGN PATENTS OR APPLICATIONS

| | | | |
|---|---|---|---|
| 357,963 | 12/1961 | Switzerland | 248/DIG. 3 |

*Primary Examiner*—James T. McCall
*Assistant Examiner*—Terrell P. Lewis
*Attorney, Agent, or Firm*—James E. Nilles

[57] ABSTRACT

A decorative permanent merchandise display rack including structural support means for removably mounting a plurality of vertically oriented display shelf units so as to be rotatable around a vertical axis. The display rack includes a base member which rotatably supports a central vertically disposed post and a spider member fixedly mounted at each end of the post. Vertically disposed plastic shelf units are provided with means to be removably mounted on radially outwardly extending projections of said spiders in such a manner that they can be easily lifted from the spiders to be removed or replaced.

7 Claims, 5 Drawing Figures

MERCHANDISE DISPLAY RACK

BACKGROUND OF THE INVENTION

The present invention relates to permanent display devices, and particularly to such devices which are used for merchandising cigarettes in retail sales establishments. Such devices are shown, for example, by the design patent issued to Nielsen, U.S. Pat No. Des. 227,951, patented July 31, 1973, and by the patent to Crosslen, U.S. Pat. No. 3,820,862, issued June 28, 1974.

SUMMARY OF THE INVENTION

The present invention provides a merchandise display rack which is attractive to customers, which has structural simplicity and strength, and which can be easily assembled and disassembled. The display device has a lower profile than previous display devices of similar type but accommodates a substantial quantity of display merchandise.

The display rack includes a base member which is mounted upon casters or rollers so as to be movable and a central vertically disposed post which is rotatably mounted on the base member. The central post has spider members attached adjacent its upper and lower ends. The spider members each include a plurality of laterally extending arms which support vertically disposed display shelf units which accommodate the merchandised articles. Each of the arm members of the spiders includes a pair of mounting surfaces, these surfaces being arranged at an angle to each other and being verically positioned with respect to a complementary pair of surfaces of the other spider. Each of the mounting surfaces includes a perpendicularly extending projection which is designed to be received in a keyhole slot in the display shelf units. The arrangement of the spider arms and their mounting surfaces is such that display shelf units can be mounted adjacent to each other around the central post.

The spider members are secured in position on each end of the central post merely by tightening screws to shrink-fit the spider members around the post. Once in position the spider members and their laterally extending arms provide a very stable structure for the display shelf units. The units can be easily removed from the spiders by lifting them upwardly and pulling them away from the projections receivable in the keyhole slots, thus facilitating assembly of the display rack, replacement of the shelf units and easy filling of the display shelf units with merchandise.

The structural features of the merchandise display rack of the present invention result in a display rack which is attractive to customers, relatively inexpensive to construct and capable of displaying a substantial quantity of merchandise while requiring relatively little floor space. The display rack is easy to assemble so that one of relatively little skill can assemble the rack in the retail establishment, but when assembled the rack is stable so as not to be upset by mishandling and is durable so as not to be damaged by customer abuse. The display rack is also designed to have a relatively low profile so as not to obscure the view of store personnel.

DESCRIPTION OF A PREFERRED EMBODIMENT

Figure 1:
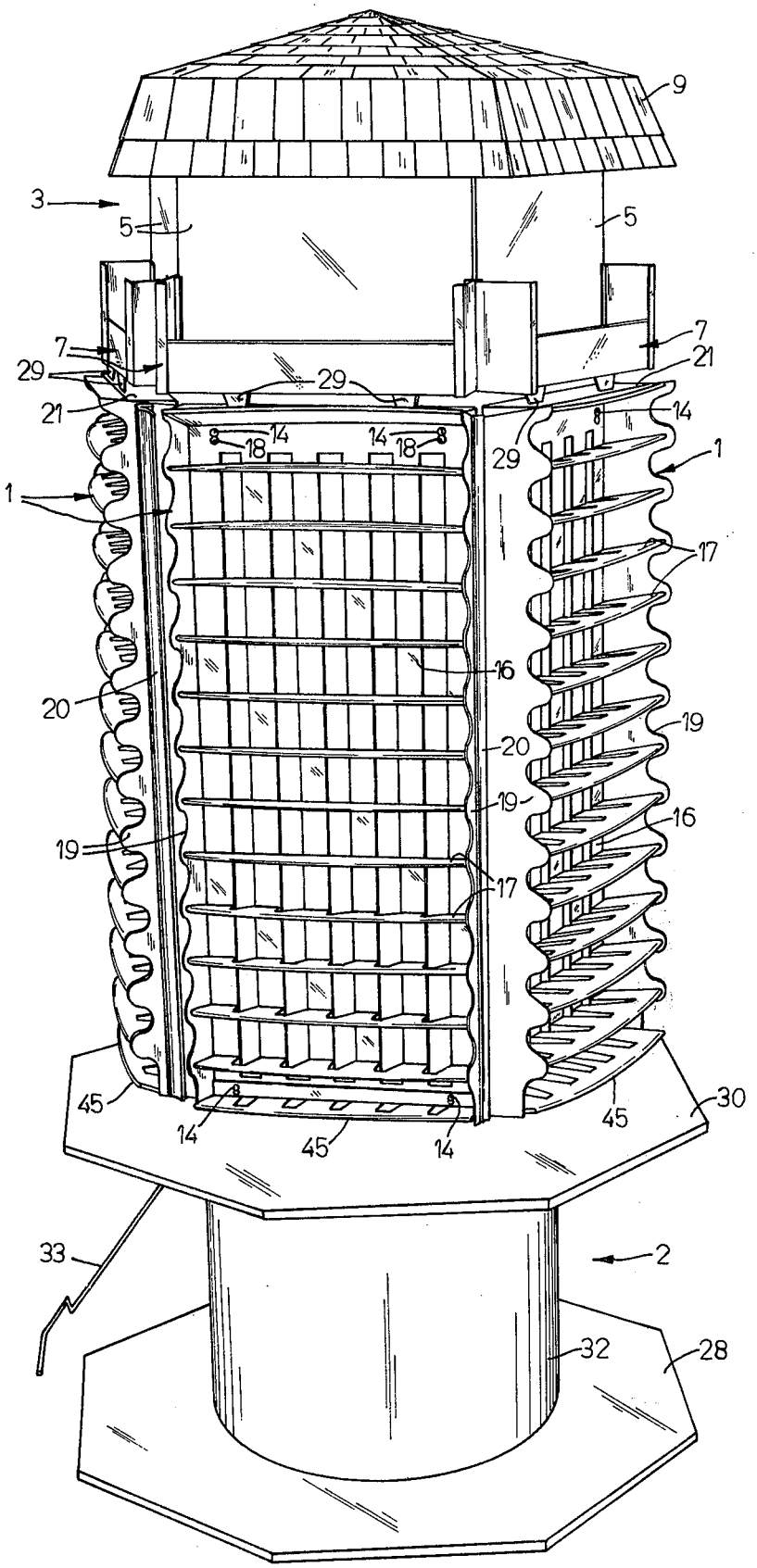
FIG. 1 is a perspective view of the merchandise display rack of the present invention in a fully assembled state.

FIG. 1 shows a perspective view of the merchandise display rack of the present invention. As shown therein, the display rack generally comprises a plurality of display shelf units 1 arranged adjacent to each other around a central vertical axis, and supported by a base structure 2. Attached to the upper part of the display rack is a decorative crown 3 including an upper supplementary shelf 7, means for supporting advertising signs 5, and a cover 9.

Figure 2:
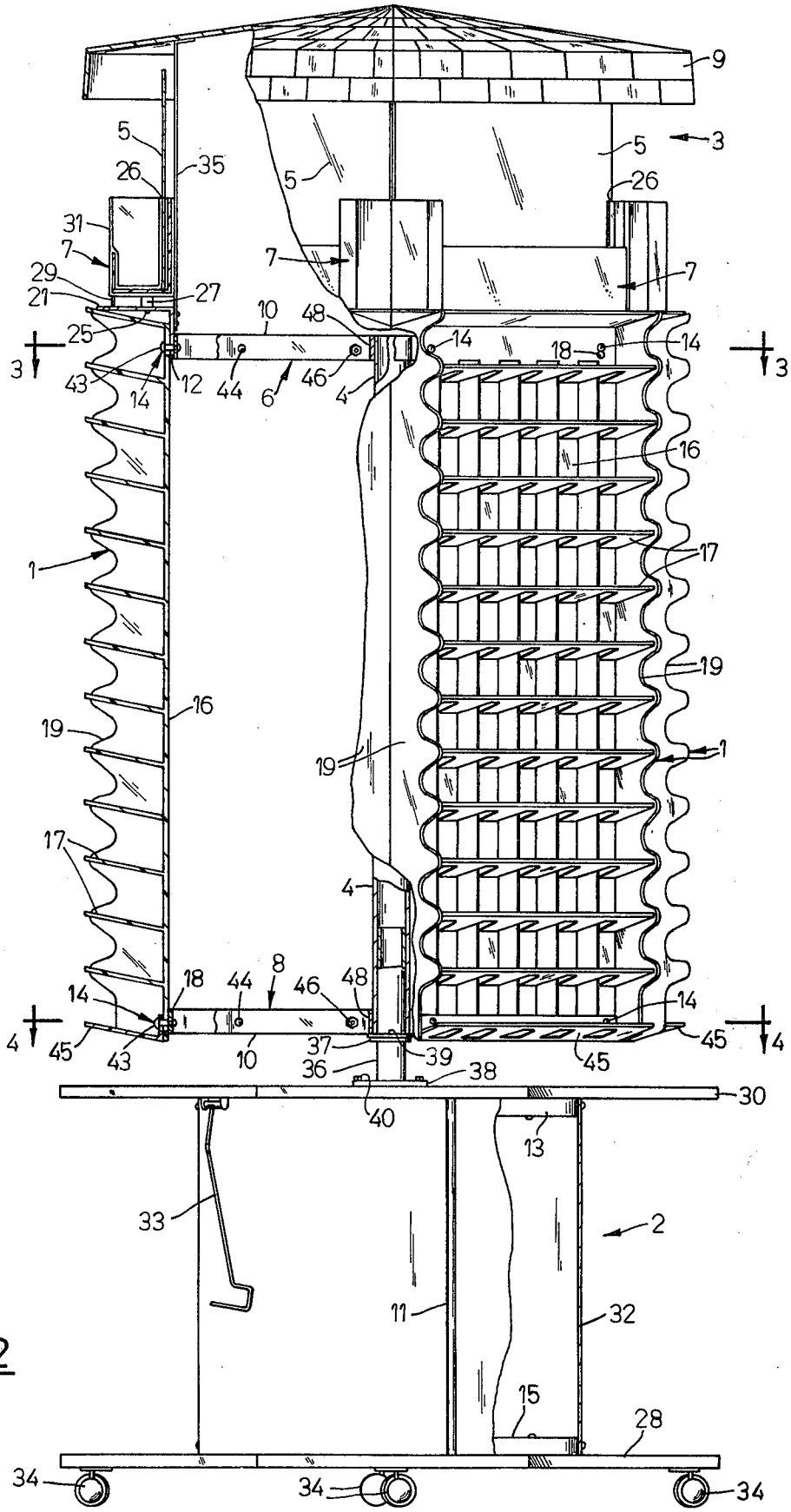
FIG. 2 is a side elevation view of the merchandise display rack partially broken away to show the supporting structure.

FIG. 2 illustrates in greater detail the structural relationship of the elements of the display rack and shows the means provided for supporting the display shelf units 1 and the crown 3.

Generally, the merchandise display rack includes a base structure 2 which supports a central vertically disposed post 4 in such a manner that the post 4 is rotatable about its axis. Spider members 6 and 8 are rigidly secured at each end of the post 4 in such a manner as to be rotatable therewith. Each of the spider members 6 and 8 has a plurality of radially extending arms 10 which include a pair of vertically disposed mounting surfaces 12 at their radially outward ends. The mounting surfaces 12 each include perpendicularly extending projections 14 for being received in keyhole slots 18 in the vertically disposed display shelf units 1 for supporting said shelf units.

BASE MEMBER

As shown in FIG. 2, the base structure 2 of the present invention includes two horizontally disposed platforms 28 and 30 rigidly attached to a cylinder 32 formed from sheet metal joined at seal 11 and secured to the periphery of upper and lower discs 13 and 15, respectively. The upper platform 30 includes a handle 33 pivotably attached to its lower surface, and the lower platform 28 includes on its lower surface a plurality of rollers or casters 34 for facilitating relatively easy movement of the display rack. The upper platform 30 supports a cylindrical shaft 36 having a butt plate 38 which is secured by screws 40 to the center of the upper surface of the platform 30. At a predetermined distance from its lower end, the shaft 36 includes a collar 37 rigidly secured thereto for supporting a washer 39 and the vertically disposed post 4. The shaft 36 has an outside diameter which is slightly less than the inside of the post 4 such that the upper end of the shaft 36 can be received within the lower end of the central vertically disposed post 4 to maintain it in a vertical position. The washer member 39 and the slight clearance between the surfaces of the post 4 and the shaft 36 facilitate relatively free rotation of the post.

DISPLAY SHELF UNIT SUPPORT STRUCTURE

Figure 3:
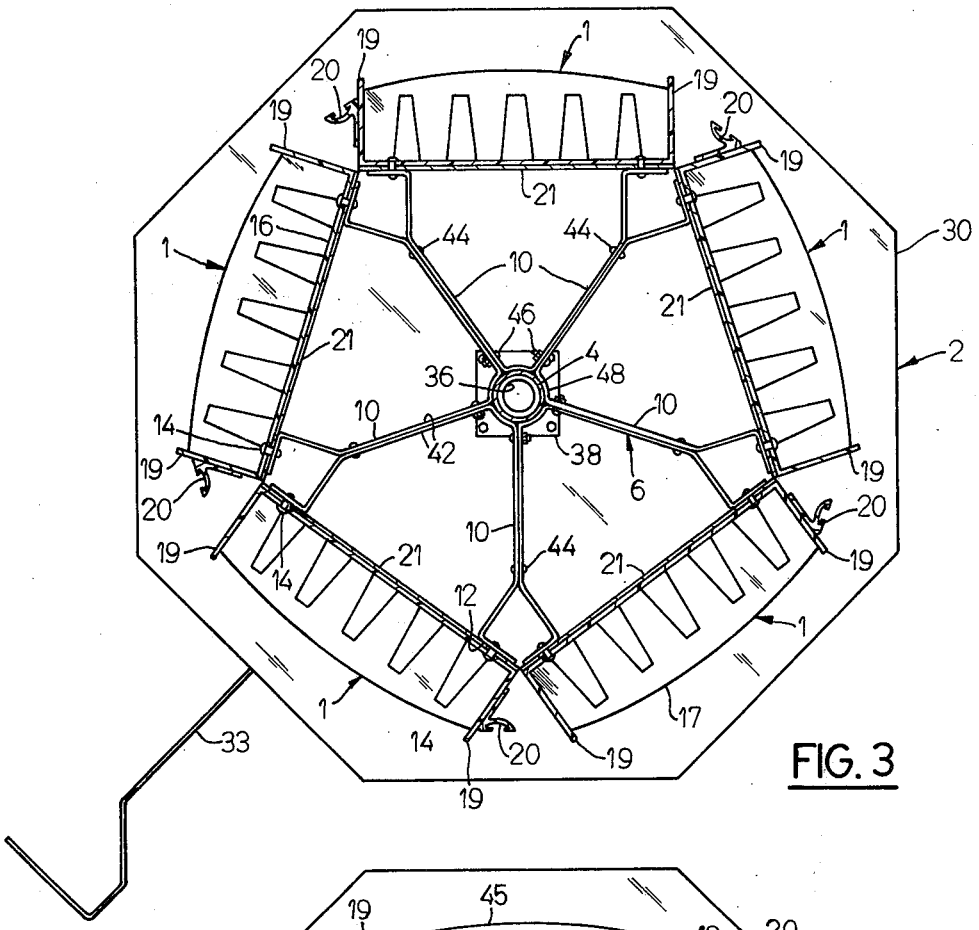
FIG. 3 is a cross-sectional plan view of the display rack taken through line 3—3 of FIG. 2.
Figure 4:
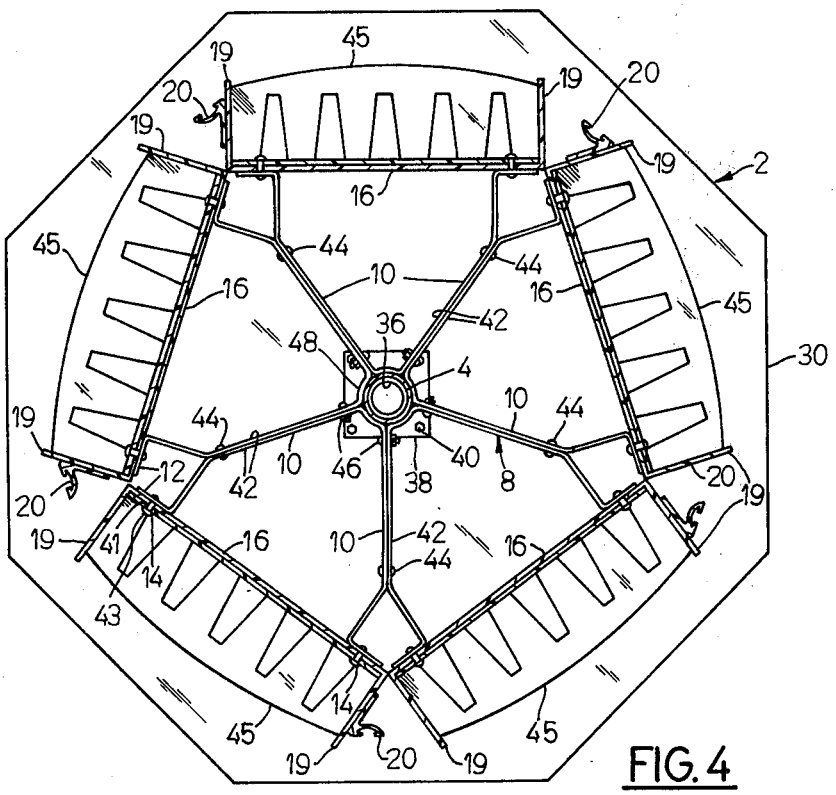
FIG. 4 is a view similar to FIG. 3 but taken through line 4—4 of FIG. 2.
Figure 5:
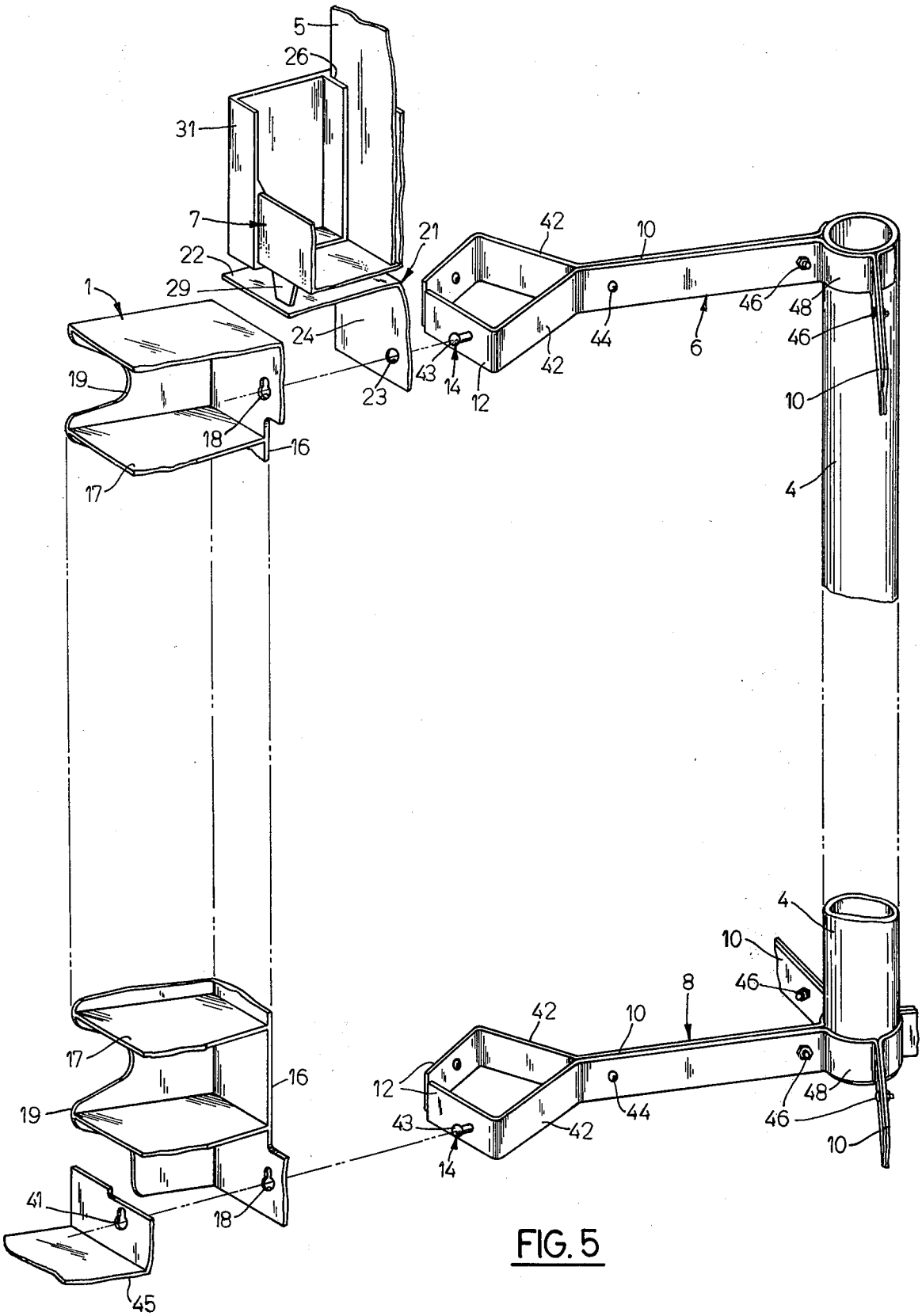
FIG. 5 is an exploded view of the assembly of the shelf units and the spiders with portions thereof deleted in the interest of clarity.

The central vertically disposed post 4 includes at each of its ends spider assemblies 6 and 8 which, as shown in FIGS. 3 and 4, each consist of a plurality of brackets 42 rigidly held together by rivets 44 and screws 46. Each bracket member 42 is riveted to two adjacent bracket members by a rivet 44 and is also secured to those bracket members by screws 46. The spiders 6 and 8 composed of these brackets 42 define a central hub portion 48 designed to fit around the central post 4. During assembly of the display device, the spiders 6 and 8 may be easily attached to the central post 4 by merely sliding them onto the post, such that the hub portion 48 of the spiders fit around the post and by then tightening the screws 46 causing the brackets 42 to be pulled together in a tightened relationship such that the hub portion 48 of the spider contracts in a clamping relationship around the post 4. When the spiders 6 and 8 have been attached to the central post 4, they include a plurality of radially extending arms 10 which each have a pair of vertically extending mounting surfaces 12 at the radially outward ends. As best shown in FIG. 5, each of the mounting surfaces 12 includes a perpendicularly extending projection 14 for supporting the prefabricated display shelf units 1. The spiders 6 and 8 are positioned relative to each other such that each of the mounting surfaces 12 of the upper spider 6 is aligned vertically over the respective mounting surface 12 of the lower spider 8 so that the respective mounting surfaces 12 of the spiders 6 and 8 lie in the same plane and such that the projections 14 are in vertical alignment.

As previously stated, removably attached to the radially extending arms 10 of the spiders are a plurality of vertically positioned prefabricated disply shelf units 1, each including a plurality of shelves 17 for merchandise display. The display shelf units 1 generally have an open side for access to the merchandise, an opposite back side 16 and two opposing scalloped side walls 19 joining the open and back sides. Each of the display shelf units includes a vertically extending tab channel 20 rigidly attached to the outside surface of one of the side walls 19. The back side 16 of the shelf units 1 has four keyhole slots 18 therein and properly positioned so as to receive projections 14 extending from the radially extending arms 10 of the spiders 6 and 8. The keyhole slots are arranged such that the shelf unit includes two spaced keyhole slots 18 in its upper portion for receiving the projections 14 extending from two of the arms 10 of the upper spider 6 and two additional spaced keyhole slots 18 in its lower portion to receive the projections 14 of two of the arms 10 of the lower spider 8.

As shown in FIGS. 2 and 4-5, the projections 14 of the lower spider 8 also support, in addition to shelf units 1, lower supplementary shelves 45 having keyhole slots 41. When assembled, the lower supplementary shelf 45 and the shelf unit 1 are wedged between the surface 12 and the enlarged end 43 of the projection 14 so that they are securely held in position. These keyhole slots 18 and 41 and complementary projections 14 thus securely support the display shelf units but allow relatively easy removal of the display shelf units 1 and the lower supplementary shelves 45 if they are pulled upwardly and then outwardly away from the spiders.

The projections 14 of the upper spider 6 also support angular brackets 21 which in turn provide support for supplementary display shelves 7, the advertising signs 5 and the cover 9. Each angular bracket 21 includes a horizontal portion 22 and a vertical portion 24 and further includes bores 23 in opposite ends of the vertical portion for receiving therein the projections 14. As shown in FIG. 2, each of the supplementary display shelves 7 is secured to the upper surface of the horizontal portion 22 of one of the angular brackets 21 by screws 25 which pass through bores in the bracket 21 and are threadably received in spacer projections 27 which extend downwardly from the bottom surface of the supplementary display shelf 7. The position of the shelf 7 with respect to the angular bracket 21 is also maintained by supporting legs 29 which extend downwardly from the front edge of the shelf 7 and rest on the angular bracket 21. Each of the shelves 7 also includes a shelf end 31 slidably received on and supported by the ends of the shelf 7. Each shelf end 31 includes a groove 26 for receiving the advertising sign 5 so that the sign 5 is securely supported. The angular brackets 21 also have support straps 35 (FIG. 2) riveted to the vertical portion 24 and extending upwardly so as to support the cover 9.

During the assembly process, when the angular bracket 21 having the supplementary display shelf 7 attached thereto and the display shelf unit 1 are received on the projections 14 they are held in relatively tight abutting relationship between the head portion 43 of the projection 14 and the surface 12.

RESUME

The structure of the merchandise display rack of the present invention thus provides a means for facilitating relatively easy assembly and disassembly of the component parts of the display rack without sacrifice of stability or durability and provides a display rack having a low profile but accommodating a substantial quantity of retail merchandise.

The supporting structure of the display rack, including the spider members and the means for removably attaching the display shelf units to the spiders, yields optimal strength but is uncomplicated to produce and economical. By providing a display rack which is readily assembled or disassembled without complicated tools or undue skill, the display rack can be readily assembled by relatively unskilled personnel in the retail establishment where it is to be used.

I claim:

1. In a multi-sided merchandise display rack the combination comprising: a central vertically disposed post, a plurality of spiders mounted on said post in vertically spaced relationship to one another, each of said spiders having a hub received on said central post and having means for attachment thereto, a plurality of radially extending arms connected to said hub in circumferentially spaced relation therefrom, the outer end of each arm having a pair of mounting surfaces, said surfaces arranged at an angle to one another, said mounting surfaces each being coplanar with and spaced from an adjacent mounting surface of an adjacent arm and said surfaces of said vertically spaced spiders being respectively vertically aligned, a plurality of vertically positioned display shelf units mounted on said spaced coplanar mounting surfaces of adjacent arms and means for detachably connecting said display shelf units to said surfaces.

2. The display rack as defined in claim 1 further characterized in that said means for detachably connecting said display shelf units to said surfaces comprises projections and keyhole slots, said projections being received within said keyhole slots whereby said display shelf units may be lifted from said spiders for disassembly.

3. The device as defined in claim 1 including a support stand and wherein said vertically disposed post is rotatably mounted upon said stand to allow rotation of said display shelf units.

4. The device as defined in claim 1 wherein one of said spiders is mounted adjacent the upper end of the center post and a supplementary display shelf is removably mounted on said one spider.

5. The device as defined in claim 1 further characterized by said spiders comprising a plurality of brackets secured together and wherein said means for attaching said spiders to said post comprises clamping means for rigidly securing said hub against said post.

6. The device of claim 1 wherein said vertically positioned display shelf units include a plurality of shelves to support merchandise, an open side for access to merchandise therein, a closed side opposite to said open side and two opposite side walls joining said open and closed sides.

7. In a multi-sided merchandise display rack the combination comprising: a central vertically disposed post, upper and lower spiders mounted on said post in vertically spaced relationship to one another, each of said spiders having a hub on said central post and having a clamping means for attachment thereto, a plurality of radially extending arms connected to said hub in circumferentially spaced relation therefrom, the outer end of each arm having a pair of mounting surfaces, said surfaces arranged at an angle to one another, said mounting surfaces each being coplanar with and spaced from an adjacent mounting surface of an adjacent arm and said surfaces of said upper and lower spiders being respectively vertically aligned, a plurality of vertically positioned display shelf units mounted on said spaced coplanar mounting surfaces of adjacent arms, and attaching means for detachably connecting said shelf units to said surfaces, said attaching means comprising keyhole slots and projections between said surfaces and shelf units whereby said shelf units may be lifted from said spiders for disassembly and including a support stand and wherein said vertically disposed post is rotatably mounted upon said stand to allow rotation of said display shelf units.

* * * * *